United States Patent [19]

Crathern et al.

[11] 4,070,226

[45] Jan. 24, 1978

[54] REGISTRATION SYSTEM

[75] Inventors: Charles F. H. Crathern, Contoocook; Sherman W. Twitchell, Hopkinton, both of N.H.

[73] Assignee: Crathern Engineering Co., Inc., Contoocook, N.H.

[21] Appl. No.: 761,453

[22] Filed: Jan. 21, 1977

[51] Int. Cl.[2] ..... B65C 9/40

[52] U.S. Cl. ..... 156/364; 226/32; 226/109; 271/9

[58] Field of Search ..... 156/362–364, 156/361, 367, 378, 64; 226/115, 32, 43, 109, 2, 29–30, 39; 271/265, 9

[56] References Cited

U.S. PATENT DOCUMENTS

| | | | |
|---|---|---|---|
| 2,968,430 | 1/1961 | Martin et al. | 226/32 |
| 3,816,210 | 6/1974 | Aoko et al. | 156/361 X |
| 3,867,889 | 2/1975 | Conner | 226/115 X |
| 3,930,725 | 1/1976 | Jones | 271/9 X |

*Primary Examiner*—David A. Simmons
*Attorney, Agent, or Firm*—Schiller & Pandiscio

[57] ABSTRACT

A high speed system is provided for bringing a plurality of articles, each moving independently in a separate path and at its own speed into registration with each other at a processing station. In applying the invention to a case making machine, successive boards are brought into registration with successive sheet areas defined on a continuous web which moves at a predetermined constant speed. Each board moves at a speed greater than the web speed until registration with the desired sheet area is obtained. A counter measures the registration differential between predetermined detection indicia on each article by keeping track of the distance travelled by each indicium beyond a reference position in the path of the corresponding article. When registration is obtained, the articles are transported at a common speed to the processing station where the separate paths converge.

20 Claims, 3 Drawing Figures

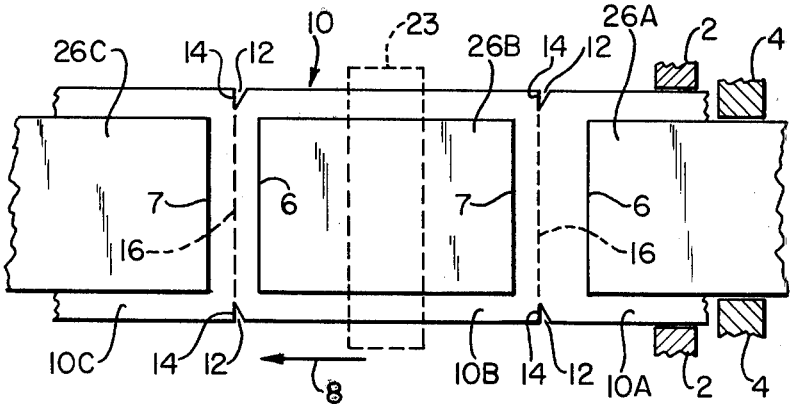
FIG. 1
FIG. 2
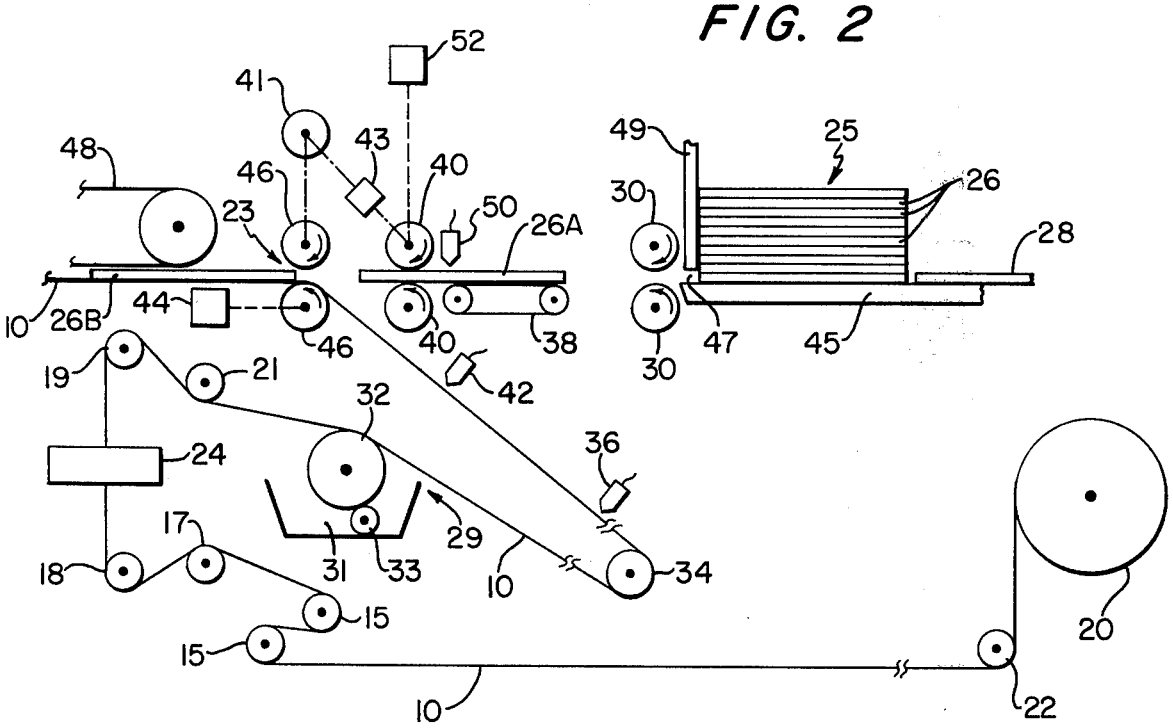

REGISTRATION SYSTEM

The present invention relates in general to a new and improved system for bringing a plurality of articles travelling at different speeds in separate paths into registration with each other at a processing station where the paths converge, and in particular to a registration system for bringing a detectable indicium on an elongated flexible sheet into a predetermined spatial relationship with a detectable indicium on a relatively rigid board at the aforesaid station. While the invention may find applicability in different areas, it will be explained in connection with a specific manufacturing process.

In the manufacture of book bindings or cases, a board consisting of a relatively rigid material such as wood or a stiff cardboard is covered with a flexible material such as paper, cloth, plastic or the like, fastened to the cardboard. Fastening or joining may be carried out by applying an adhesive to one or both facing surfaces of the articles to be joined and urging them into contact with each other.

It is important in such an operation that the board and the sheet which is to form the covering material are in registration with each other by the time the joining station is reached. Lateral registration between the two articles, i.e. alignment normal to the direction of travel but in the respective travel planes, is readily provided by suitable guides or roller flanges which keep the board and the sheet in line as they move toward the joining station in their respective paths. However, registration in the direction of travel presents a problem, particularly at high speeds of operation. This is true regardless of whether pre-cut sheets are used with which successive boards must register, or whether a continuous web is employed on which successive sheet areas are defined by indicia spaced lengthwise along the web. In the latter arrangement, the web is severed into discrete sheets only after the boards have been fastened to the web at the joining station.

"Perfect" registration is said to occur when a board is centered on a sheet area (or on a discrete sheet) within 1/32 inch of a predetermined position. However, in present day equipment the operating speeds are such that the boards and the web can travel to the joining station at speeds as high as 150 feet per minute. At these speeds, registration errors in the direction of travel may amount to as much as ½ inch. Errors of such magnitude constitute a major problem with respect to the average case or binding, which may be of the order of 16 inches long. Thus, notwithstanding the use of corner tucks, large misregistration errors are instrumental in creating "dog ears" in the covered case that represents the final product. Further, while one transverse edge binding of the misregistered board will have too much material, the opposite edge will have insufficient material and a poor edge binding may result. While it is possible to use oversized sheets to allow for such variations, such a practice is wasteful of sheet material and it increases the cost of the end product. In either case, the presence of dog ears, poor edge bindings, and margins of different widths are unacceptable in the end product.

Heretofore, the usual solution to the problem of misregistration has been to slow down the speed of operation of the case making equipment. This has resulted in undesirable economic consequences which tend to raise the cost of manufacture and hence the price of the end product.

OBJECTS OF THE INVENTION

It is a primary object of the present invention to provide a new and improved registration system which is not subject to the foregoing disadvantages.

It is another object of the present invention to provide a new and improved registration system which makes possible high speed manufacturing operations and concomitant cost savings.

It is a further object of the present invention to provide a high-speed system for bringing a plurality of articles travelling in different paths into accurate registration at a processing station common to said paths.

It is still another object of the present invention to provide a new and improved system for providing accurate registration at a processing station between discrete areas of an elongated web travelling at a selected predetermined speed in a first path and successive boards travelling at a variable speed in a separate path.

SUMMARY OF THE INVENTION

In accordance with the present invention, a registration system is provided wherein a plurality of different articles, such as the aforesaid board and flexible sheet, travel at different respective speeds, each in its own path, to a processing station. Each path includes a reference position and means for measuring the distance travelled by each article beyond the corresponding reference position. A comparison of the measured distances provides an indication of the registration differential. The speed of travel of each article is chosen such that the registration differential is reduced to zero prior to the time that the processing station is reached. Upon registration, the respective travel speeds are equalized so that both articles can proceed to the processing station in unison while maintaining registration with each other.

These and other objects of the present invention, together with the features and advantages thereof, will become apparent from the following detailed specification when considered in conjunction with the accompanying drawings in which like reference numerals designate like parts in the different Figures.

BRIEF DESCRIPTION OF THE DRAWINGS

FIG. 1 illustrates the registration process as provided by the present invention, with reference to a series of boards and successive, defined sheet areas of an elongated web.

FIG. 2 illustrates a preferred embodiment of a case making machine which incorporates the principles of the present invention.

With reference now to the drawings, FIG. 1 shows a series of boards 26A, 26B and 26C superposed on successive sheet areas 10A, 10B and 10C of an elongated continuous web 10 on which the sheet areas are defined by successive pairs of opposed notches 12 spaced along the length of the web. Each notch includes a leading notch edge 14 which is normal to the corresponding edge of the web. Notch edges 14 of each opposed pair of notches 12 are aligned with each other along transverse line 16, shown in dotted outline in FIG. 1, which defines the border between successive sheet areas 10A, 10B and 10C. Web 10 may consist of paper, cloth, plastic, or the like and travels in the direction of arrow 8. It is constrained against lateral movement by conventional means, e.g. by suitable guides 2 which may be separately provided. Alternatively, the flanges of the rolls used to transport the web along its own path can serve as guides.

Figure 3:
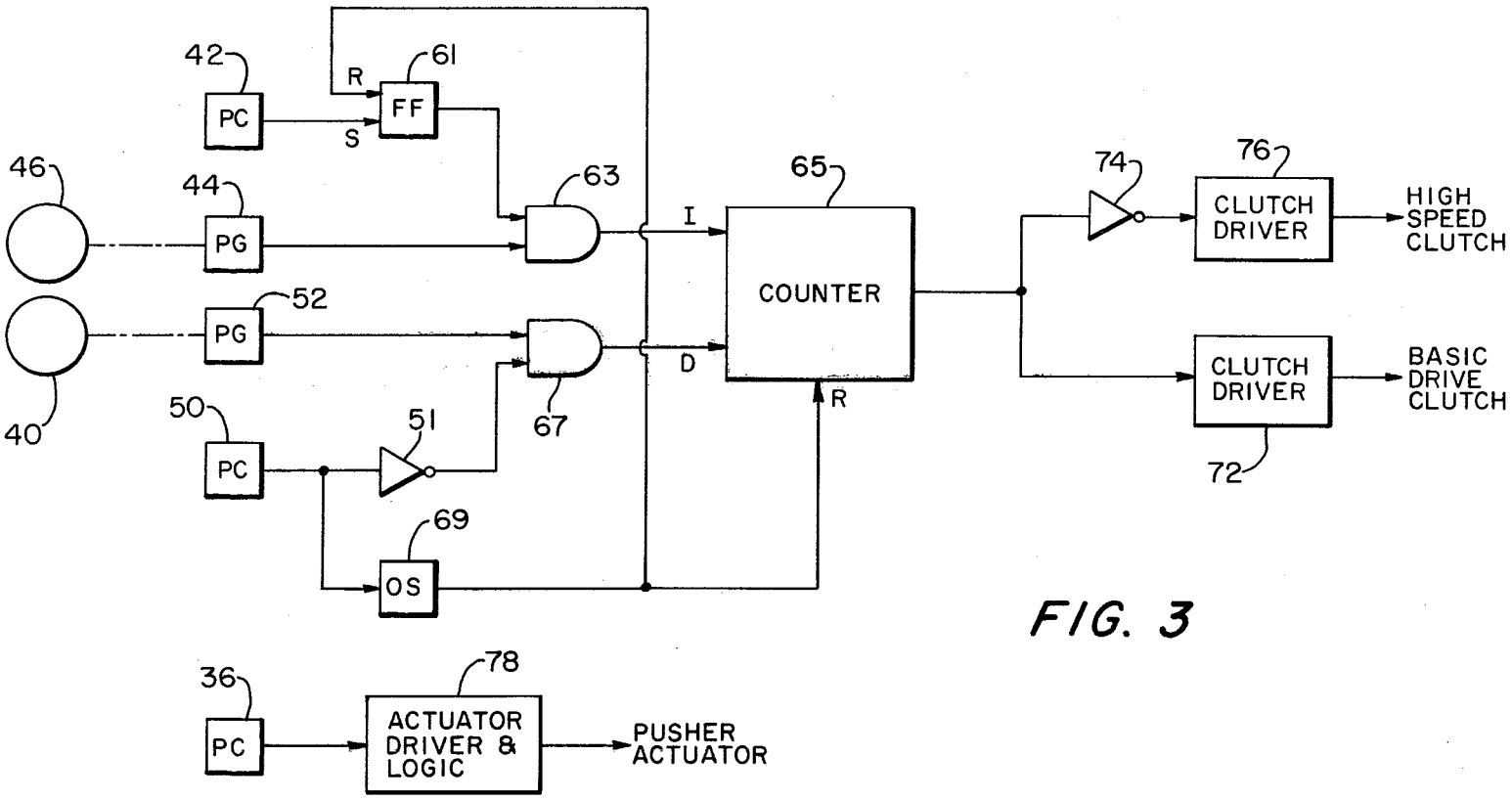
FIG. 3 illustrates a registration control system for use with the apparatus of FIG. 2.

Boards 26A, 26B, 26C similarly travel in the direction of arrow 8, but in a separate path which converges with the path of web 10 at a joining station 23. Boards 26 are similarly constrained against lateral motion by guides 4. The separate paths of the web and of the boards are best illustrated in FIG. 2.

The purpose of the registration system which forms the subject matter of the present invention is to bring each board into registration with a corresponding sheet area before the station is reached, (indicated in dotted outline at 23, in FIG. 1), where they are permanently joined together. As illustrated by board 26B and sheet 10B, the board is centered on the sheet when the two are in registration with each other. More specifically, a detectable indicium of each board 26, e.g. leading board edge 6, must be brought into registration with a detectable indicium of the corresponding sheet of web 10, e.g. leading notch edge 14 or its extension in the form of line 16. For purposes of explanation, registration between the aforesaid indicia can be taken to mean that leading board edge 6 must be spaced a predetermined distance behind line 16 before joining station 23 is reached. As illustrated in FIG. 1, leading edge 6 of board 26A is approaching registration with line 16 that separates sheet 10A from sheet 10B. Boards 26B and 26C are in registration with sheets 10B and 10C respectively, i.e. they are centered on the aforesaid sheets. Accordingly, in the example shown leading and lagging board edges 6 and 7 respectively of each board should be equidistantly spaced from lines 16 which define the boundaries of the sheet area on which such board is to be centered.

FIG. 2 illustrates a preferred embodiment of a case making machine wherein a board 26A is shown approaching joining station 23 and a second board 26B is shown leaving the station. The path of relatively flexible web 10 is seen to extend between a web supply roll 20 and joining station 23, as described below. A notching station 24 is adapted to provide the aforesaid pairs of notches 12 at spaced intervals in the opposite edges of web 10. The path between supply roll 20 and notching station 24 includes a guide roll 22, a pair of tensioning rolls 15, a guide roll 17 and a compensating roll 18 which stabilizes the web for punching. The path on the other side of the punching station includes a compensating roll 19 and a guide roll 21, followed by a glue dispensing station 29. Station 29 comprises well 31 and glue dispensing roll 32. Glue is constantly applied to roll 32 by applicator roll 33 which is at least partially submerged in well 31. Glue dispensing roll 32 is adapted to apply glue to the underside of web 10, as the latter comes in contact with the surface of roll 32. As shown, web 10 follows a relatively extended path portion between glue dispensing roll 32 and joining station 23 in order to afford the applied adhesive an opportunity to cure to a state where it becomes tacky. Dancer roll 34 is arranged to provide lateral position control in the aforesaid extended path portion.

Photocell 36 is stationed at a first predetermined position adjacent the web path between roll 34 and station 23 and is adapted to provide an output pulse upon detection of each notch edge 14 passing by it. Similarly, photocell 42 is stationed at a second predetermined position adjacent the web path but closer to station 23 and provides an output pulse when notch edge 14 is detected.

Joining station 23 comprises a pair of basic drive rolls 46 which are spaced so as to urge the adhesive-carrying web surface against any board 26 that reaches the joining station at the same time. Drive rolls 46, which are mechanically coupled to basic drive motor 41, as indicated by a dotted line connection in FIG. 2, constitute the basic drive for transporting web 10 at a selected predetermined, speed from supply roll 20 forward. In a specific embodiment of the invention, the basic drive is operated at a constant speed. Drive rolls 46 are further mechanically coupled to a pulse generator 44, which is adapted to provide a train of output pulses at a pulse rate dependent on the rotational speed of rolls 46. Each pulse represents a discrete angular increment of rotation of rolls 46 and hence a unit of distance by which web 10 has advanced in contact with these rolls. Thus, the total number of pulses generated in a given period represents the total distance traveled by the web during that period and it is independent of the speed at which such distance was covered.

A stack 25 of uniform, flat and relatively rigid boards 26 is supported on base 45, the boards being aligned edgewise, as by vertical wall 49. An opening 47 is defined between support 45 and wall 49, which is dimensioned to permit a pusher actuator 28 to eject one board at a time from the bottom of stack 25. The pusher mechanism may be of conventional construction and it is preferably of the type responsive to an electrical signal for ejecting successive boards 26 through opening 47 in response to successive actuating signals. Mechanisms of the type are well known in the art and are shown, for example, in U.S. Pat. No. 3,814,343. For the sake of clarity and because it is only collaterally related to the present invention, the mechanism has beem omitted from the drawings.

A pair of drive rolls 30, operating at relatively high speed, is positioned in line with opening 47 to move each emerging board rapidly onto a conveyor 38. A photocell 50 is stationed at a predetermined position adjacent the path of the boards which extends between stack 25 and joining station 23. As will be explained further hereinbelow, cell 50 is typically adapted to provide a DC output signal which changes voltage levels each time one of edges 6 or 7 passes under the cell.

A pair of variable speed drive rolls 40 is positioned adjacent the path of the board between the position of photocell 50 and station 23. Drive rolls 40 are mechanically coupled to a clutch mechanism 43 which may selectively transmit power to these drive rolls either directly at the rotational speed of basic drive rolls 46 or, through suitable gearing included in unit 43, at a higher speed, e.g. at 110% of the basic drive roll speed in a preferred embodiment of the invention. Alternatively, a separate power source may be used as a high speed drive.

The clutching mechanism required for alternatively clutching rolls 40 to the basic drive or the high speed drive may comprise conventional two-way clutching apparatus which has been omitted from the drawings for the sake of clarity. For example, a cone type friction clutch may be employed of the type illustrated on page 224 of Volume 3 of the Encyclopedia of Science and Technology, published by MacGraw-Hill Book Company, Inc., Copyright 1960.

Drive rolls 40 are further mechanically coupled to pulse generator 52 which is adapted to provide a train of output pulses at a pulse rate dependent on the rotational speed of rolls 40. Each pulse represents a discrete angular increment of rotation of rolls 40 and hence a unit of distance by which board 26A has advanced in contact with rolls 40. The total number of pulses generated in a given period represents the total travel of board 26A during that period, independent of the speed at which the distance was covered. In a preferred embodiment of the invention the distance units represented by pulse generators 44 and 52 are identical.

Beyond joining station 23 a conveyor 48, typically of the known belt type, is provided to transport web 10 and board 26B, now joined together, to the next processing station. For example, the next processing station may provide means for cutting the web along lines 16 into discrete sheets.

FIG. 3 illustrates a control system which is adapted to operate with the apparatus of FIG. 2 to provide the desired registration between each board and the corresponding sheet area, i.e. to provide the desired spatial relationship between notch edge 14 and leading board edge 6. The output of photocell 36 is connected to a circuit 78, designated as an actuator driver and logic circuit. The output of circuit 78 is applied to pusher actuator 28 which, when energized, causes the next board 26 from the bottom of stack 25 to be ejected through opening 47.

Photocell 42 is connected to the Set input of a flip-flop 61, the output of which is connected to an AND gate 63. Pulse generator 44, which is coupled to basic web drive 46, has its output connected to another input of the aforesaid gate 63. The output of gate 63 is connected to the Increment input of an up-down counter 65.

Pulse generator 52, which is mechanically coupled to drive rolls 40, has its output connected to an input of another AND gate 67. Photocell 50 is connected to an inverter 51, which in turn is connected to another input of gate 67. The output of gate 67 is connected to the Decrement input of up-down counter 65. Photocell 50 is further connected to a one-shot multivibrator 69. The output of one-shot 69 is connected to the Reset input of the aforesaid counter 65, as well as to the Reset input of flip-flop 61.

The output of counter 65 is directly connected to a clutch drive 72 which is adapted to provide an output signal for clutching rolls 40 to the basic web drive 46 through the medium of clutch mechanism 43. The output of counter 65 is further connected to an inverter 74 which is in turn connected to a clutch driver 76. The output signal of the latter driver is adapted to clutch drive rolls 40 to the high speed drive through clutch mechanism 43.

In operation, web 10 is unrolled from supply roll 20 at a speed determined by basic web drive 46. As the web passes punching station 24 it is notched in the manner illustrated and explained above. Notching will occur periodically in accordance with the length of the web which is advanced by basic drive 46. Thus, successive sheet areas 26A, 26B, 26C, etc. are defined on continuous web 10, as explained above in connection with FIG. 1.

As notch edge 14 of the next sheet to arrive at photocell 36 passes the latter cell, it is detected and a pulse is generated which is applied to actuator driver and logic circuit 78. The resultant output signal of circuit 78 energizes pusher actuator 23 to cause the bottom board 26A of stack 25 to be ejected through opening 47. As soon as board 26A reaches drive rolls 30, it is seized and moved forward at high speed onto conveyor 38.

When the aforesaid notch edge 14 reaches photocell 42, the latter emits a pulse which sets flip-flop 61 so as to condition AND gate 63 for the arrival of pulses from pulse generator 44. As previously explained, each pulse provided by pulse generator 44 represents a discrete distance of travel by which the article in question is advanced by basic drive 46. These pulses, no longer blocked now by gate 63, are applied to the Incrementing input of counter 65. Each pulse so applied increments the count by one. At any given instant then, the total number of pulses so applied to the incremented input represents the total distance by which notch edge 14 has advanced beyond the position of photocell 42 along the web path.

Photocell 50 is of the type that provides a steady state output signal as long as the light beam reaching the photocell is not interrupted. Due to the presence of inverter 51, no signal is applied to the connected input of AND gate 67 as long as the light beam is not interrupted. When the leading edge 6 of the next board, i.e. the board ejected from stack 25 in response to the pulse generated by photocell 36, arrives at photocell 50 the output signal of photocell 50 goes to zero. Thus, as long as the board blocks the light from photocell 50, inverter 51 will apply a signal to the connected input of AND gate 67 to condition the latter for the arrival of pulses from pulse generator 52. These pulses, no longer blocked now by gate 67, are applied to the Decrement input of counter 65 at a rate dependent on the speed of rotation of drive rolls 40. Each pulse so applied decrements the count of counter 65 and thus provides a measure of the distance the leading board edge 6 has advanced beyond the position where photocell 50 is stationed.

Since the units of distance represented by the incrementing and decrementing pulses are identical, the count of counter 65 will represent the registration differential, i.e. the difference between the actual and the desired spatial relationship between leading board edge 6 and leading notch edge 14 of the corresponding sheet area. In a preferred embodiment of the present invention, the counter logic is arranged to provide a counter output signal only when the count reaches zero. In the absence of a zero count, inverter 74 energizes clutch driver 76 so as to actuate clutch mechanism 43 to couple drive rolls 40 to the high speed drive.

Although the invention is not so limited in the preferred embodiment under consideration, the distances and the relative speeds of the respective components are chosen such that the board ejected from stack 25 in response to a notch edge 14 passing under photocell 36, will reach photocell 50 after the aforesaid notch edge 14 has passed under photocell 42. Thus, incrementing of the count at the rate dictated by basic web drive 46 begins before decrementing is initiated at the rate dictated by drive rolls 40. Accordingly, as long as the count is greater than zero, drive rolls 40 will be driven at a speed higher than that of basic web drive 46, i.e. at a speed 10% higher in the assumed example. It follows, that the count will be decremented faster than it is incremented as long as drive rolls 40 are clutched to the high speed drive.

In the preferred embodiment under consideration, the position of drive rolls 40, as well as the positions of photocells 36, 42, and 50 with respect to joining station 23, are each selected with reference to the speed of the basic drive and of the high speed drive, such that registration occurs at a point prior to the joining station. Thus, the count of zero is reached before the joining station is reached. The zero count is indicative of the fact that notch edge 14 is in registration with board edge 6, i.e. that they have reached their predetermined desired spatial relationship. A responsive counter output signal is generated and clutch driver 72 is energized. Simultaneously clutch driver 76 is deenergized. Accordingly, with drive roll 40 now clutched to the basic drive, web 10 and board 26 move in unison to the joining station while the board remains in registration with the corresponding sheet area. At joining station 23 the surface of the sheet which carries the partially cured adhesive is forced into contact with the board so as to adhere thereto.

When the trailing edge 7 of the board passes under photocell 50, the photocell again provides an output signal which is applied to one-shot multivibrator 69. The resultant output pulse resets flip-flop 61 as well as counter 65, to await initiation of the next counting sequence when the subsequent notch edge 14 passes under photocell 42.

It will be apparent that the present invention provides a simple and economical system whereby two or more articles traveling in separate paths and starting their travel at different points in time, may be brought into registration with each other under high speed conditions. The invention is not limited to the specific embodiment illustrated and discussed and various substitutions and modifications are possible within the scope thereof.

For example, while the speed of one article is increased in the preferred embodiment shown, it will be clear that the speed of the article in advance of the other may be decreased, or that the speed of both may be varied to achieve registration. Further, the implementation of the clutching system, whereby drive rollers 40 are rotated either at the speed of the basic drive system or at a higher speed, may be carried out in a number of well known ways and need not be limited to the exemplary implementation referenced above.

It follows, that the invention is not limited to an arrangement where decrementing always occurs at a faster rate until registration is reached. It is within the contemplated scope of the present invention to provide a system wherein the incrementing action is performed at the higher rate. Further, any predetermined count, including zero, may be used to switch the variable transport speed to equal the predetermined speed.

Similarly, the apparatus for ejecting a board from stack 25 may be implemented in various well known ways, depending on the particular requirements of the situation. For example, the boards may be removed from the top of the stack as well as from the bottom.

Different methods exist for keying punching station 24 to the operation of the basic drive. In a practical embodiment, the output of pulse generator 44 may be employed to provide periodic notching at a rate consistent with the speed of the basic drive. In the same context, it will be appreciated that notching as such may be dispensed with in favor of the application of other types of indicia on web 10 that may be detected by sensors suitably stationed along the path of the web. Similarly, while the leading board edge is conveniently used as an indicium for activating photocell 50, other indicia may be employed.

The present invention lends itself to a number of different applications and is not intended to be limited to providing registration at a joining station of a case making machine. For example, the system may find employment for paper cutting purposes, for printing and for any other application wherein it is necessary to bring separate articles traveling independently into registration with each other.

From the foregoing explanation it will be apparent that numerous modifications, substitutions and equivalents will now occur to those skilled in the art, all of which fall within the spirit and scope of the present invention, as defined by the appended claims.

What is claimed is:

1. Apparatus for bringing a plurality of moving articles into registration with each other by establishing a predetermined spatial relationship between detectable indicia on said articles; said apparatus comprising:

transport means corresponding to each of said articles for moving said each article at its own transport speed in a separate path;

means stationed at a predetermined position along each of said paths for detecting the indicium on an article moving in said path;

means responsive to each of said transport means for measuring the distance travelled by said indicium beyond said predetermined position;

means for comparing respective measured distances to determine the instantaneous spatial relationship between respective ones of said indicia in response to the detection of said indicia;

means responsive to the differential between said instantaneous and said predetermined spatial relationships for varying at least some of said transport speeds to diminish said differential; and means for equalizing said transport speeds when said differential reaches zero indicative of said registration between said moving articles.

2. The apparatus of claim 1 wherein at least first and second articles are separately transported in their respective paths;

each of said measuring means comprising:

a pulse generator actuated by said transport means for providing a train of output pulses wherein each pulse represents a unit of distance by which the corresponding article is advanced in its respective path; and means responsive to said detection means stationed along the path of said article for initiating a count of said pulses.

3. The apparatus of claim 2 wherein said comparing means comprises a counter adapted respectively to be incremented by one of said pulse trains in response to one of said count initiating means and to be decremented by the other pulse train in response to the other one of said count initiating means;

said speed equalizing means being adapted to conform one of said transport speeds stepwise to the other transport speed when a predetermined count is reached.

4. The apparatus of claim 3 and further including:

a processing station;

respective ones of said paths converging at said processing station;

said first article comprising an elongated sheet adapted to be transported at a selected predetermined speed by its transport means;

said second article comprising a relatively rigid board; the transport means for said board being adapted to move said board respectively at a speed in excess of said predetermined speed while said count departs from zero and at said predetermined speed when said count reaches zero, said board transport speeds being chosen to achieve said registration prior to said processing station;

whereby said sheet and said board are adapted to move in unison to said station while maintaining said registration.

5. The apparatus of claim 4 wherein said sheet comprises a continuous web bearing said indicium at spaced intervals along its length; and further including:

a stack of said boards;

means for ejecting individual boards from said stack into the path of said boards;

indicium detection means stationed at a second predetermined position along the path of said web preceding said first-recited position; and means responsive to said last-recited detection means for actuating said board ejection means.

6. The apparatus of claim 5 wherein the leading edge of each of said boards constitutes one of said indicia;

said web being notched edgewise thereof at said spaced intervals, the leading edge of each of said notches being normal to the edge of said web and constituting the other one of said indicia;

said detecting means comprising photocells positioned in said paths adapted to sense said leading edges.

7. The apparatus of claim 4 and further comprising:

means preceding said processing station in the path of said sheet for applying an adhesive to one surface of said sheet;

said processing station comprising means for adhesively joining said board and said sheet together in registration with each other.

8. Apparatus for bringing a first article traveling in a first path to a processing station into predetermined registration with a second article traveling in a second path to said station, said apparatus comprising:

first transport means adapted to move said first article at a first transport speed along said first path;

first detection means for detecting said first article at a predetermined position in said first path;

first means responsive to said first transport means and said detection means for periodically measuring the distance travelled by said first article beyond said first path position following detection of said first article by said first detection means;

second transport means adapted to move said second article along said second path at least at a second transport speed different from said first transport speed;

second detection means for detecting said second article at a predetermined position in said second path;

second means responsive to said second transport means and second detection means for periodically measuring the distance travelled by said second article beyond said second path position following detection of said second article by said second detection means;

means for comparing the respective distances measured by said first and second measuring means; and means responsive to said comparing means for substantially equalizing said first and second transport speeds upon the occurrence of a predetermined relationship between said respective distances.

9. The apparatus of claim 8 and further including a collection of said second articles;

said apparatus further including third detection means for detecting said first article at another predetermined position in said first path ahead of said first-recited first path position; and means responsive to said third detection means for initiating the transfer of one of said collection of second articles into said second path.

10. The apparatus of claim 8 wherein each of said measuring means comprises a pulse generator responsive to the corresponding transport means, said pulse generator being adapted to provide a train of output pulses at a pulse rate proportional to the transport speed of said transport means wherein each pulse represents a unit of distance by which the corresponding article is advanced in its respective path.

11. The apparatus of claim 10 wherein said second transport speed exceeds said first transport speed;

said comparing means comprising a counter including means for incrementing the count thereof at the lower one of said pulse rates and means for decrementing said count at the higher one of said pulse rates following initiation of counter incrementing;

said second transport means further including means for selectively moving said second article at said first transport speed; and means operative upon the occurrence of a zero count in said counter to switch said second transport means from said second to said first transport speed.

12. The apparatus of claim 11 wherein said first article comprises a substantially flexible elongated sheet and said second article comprises a relatively rigid board;

said processing station comprising means for joining said board and said sheet together in said predetermined registration.

13. The apparatus of claim 12 and further comprising:

a stack of said boards;

third detection means for detecting said sheet at another predetermined position ahead of said first-recited first path position; and means responsive to said third detection means for initiating the transfer of a board from said stack into said second path.

14. The apparatus of claim 13 and further comprising:

a supply roll adapted to dispense said sheet substantially in a continuous length; and means positioned in said first path ahead of said third detection means for periodically applying an indicium to said sheet adapted to be sensed by said first detection means.

15. The apparatus of claim 14 wherein said indicium applying means comprises means for periodically notching said continuous sheet at opposite edges thereof to define successive sheet areas each adapted to register with one of said boards.

16. The apparatus of claim 15 wherein each of said detection means comprises a corresponding photocell;

means responsive to said first photocell for gating the output pulses of said first pulse generator to said incrementing means of said counter upon the detection of a notch by said first photocell;

means responsive to said second photocell for gating the output pulses of said second pulse generator to said decrementing means of said counter upon the detection of the leading edge of said board by said second photocell; and means responsive to said second photocell for resetting said counter upon the detection of the lagging edge of said board by said second photocell.

17. In a high-speed case maker wherein individual boards taken successively from a stack of boards are brought into registration with successive sheet areas defined on a continuous web provided by a web supply; a registration system comprising:

a station for joining said boards to said sheet areas;

a web path extending between said web supply and said joining station;

a board path extending between said stack and said joining station;

a web drive adapted to transport said web at a substantially constant, predetermined speed along said web path;

means for notching said web edgewise at spaced intervals along the length thereof, each notch having a leading edge normal to the edge of said web, each pair of successive notches defining one of said sheet areas therebetween;

a first photocell stationed along said web path and adapted to provide an output signal when said leading notch edge passes said cell;

a first pulse generator coupled to said web drive adapted to provide a pulse train wherein each pulse represents a unit of distance by which said web is advanced;

a second photocell stationed along said board path and adapted to provide an output signal when a board edge transverse to said board path passes said cell;

board drive means including a pair of board drive rolls adapted to transport said board at a variable speed;

a second pulse generator coupled to said board drive rolls adapted to provide a pulse train wherein each pulse represents the advance of a board by said board drive rolls by an amount equal to one of said units of distance;

counter means;

means responsive to said first photocell output signal for incrementing the count of said counter means for each pulse received from said first pulse generator;

means responsive to said second photocell output signal indicative of a leading board edge of decrement the count of said counter for each pulse received from said second pulse generator;

means for deriving a signal at the output of said counter means representative of said count; and means responsive to said counter output signal for driving said board drive rolls respectively at a speed greater than said predetermined web speed when said count departs from zero and at said predetermined web speed when said count is zero, said board drive roll speeds being adapted to bring said board into registration with a corresponding one of said sheet areas before said joining station is reached;

whereby said board and said sheet area are adapted to proceed in registration to said joining station at said predetermined web speed.

18. The apparatus of claim 17 and further including means responsive to said second photocell output signal indicative of a lagging board edge to reset said counter means.

19. The apparatus of claim 18 and further comprising:

a third photocell stationed along said web path ahead of said first photocell and adapted to provide an output signal when said leading notch edge passes said cell; and means responsive to each output signal from said third photocell for ejecting a board from said stack into said board path.

20. The apparatus of claim 19 and further comprising means for applying an adhesive to one surface of said web, said last recited means being positioned in said web path a distance sufficiently far from said joining station to permit at least partial curing of said adhesive before said joining station is reached at said predetermined web speed;

said joining station being adapted to urge said adhesive-bearing web surface into contact with each board passing said station in registration with a corresponding sheet area.

* * * * *